US006497592B1

(12) United States Patent
Beadle

(10) Patent No.: US 6,497,592 B1
(45) Date of Patent: Dec. 24, 2002

(54) VOLTAGE TERMINAL CONNECTOR ASSEMBLY

(76) Inventor: Joshua Beadle, 5362 Caminito Vista Lujo, San Diego, CA (US) 92101

( * ) Notice: Subject to any disclaimer, the term of this patent is extended or adjusted under 35 U.S.C. 154(b) by 0 days.

(21) Appl. No.: 09/776,541

(22) Filed: Feb. 2, 2001

Related U.S. Application Data

(63) Continuation-in-part of application No. 09/504,698, filed on Feb. 16, 2000.

(51) Int. Cl.[7] ..... H01R 4/36
(52) U.S. Cl. ..... 439/814; 439/797; 439/718
(58) Field of Search ..... 439/814, 797, 439/798, 908, 709, 718; 174/138 F

(56) References Cited

U.S. PATENT DOCUMENTS

| | | | | |
|---|---|---|---|---|
| 2,671,888 | A | * | 3/1954 | Hadden |
| 2,786,162 | A | * | 3/1957 | Ballou |
| D195,623 | S | * | 7/1963 | Leonardo |
| 3,296,576 | A | * | 1/1967 | Motten, Jr. |
| 3,850,501 | A | * | 11/1974 | Butterfield |
| 4,120,555 | A | * | 10/1978 | Shiflett |
| 4,466,679 | A | * | 8/1984 | St. Germain |
| 4,820,206 | A | * | 4/1989 | Jullien et al. ..... 439/782 |
| 4,946,405 | A | * | 8/1990 | Boehm |
| 5,588,880 | A | | 12/1996 | Wood |
| 5,595,505 | A | | 1/1997 | Duke |
| 5,704,815 | A | | 1/1998 | Shibata |
| 5,779,504 | A | | 7/1998 | Dominiak |
| 5,931,708 | A | * | 8/1999 | Annas ..... 439/798 |
| 6,074,240 | A | | 6/2000 | Bradshaw |
| 6,146,212 | A | | 11/2000 | Kipnik |
| 6,176,747 | B1 | * | 1/2001 | Rowe et al. ..... 439/721 |
| 6,224,430 | B1 | | 5/2001 | Kusuda |
| 6,238,234 | B1 | | 5/2001 | Sedlecky |

OTHER PUBLICATIONS

FX Luminaire, Installation Instructions, PowerX Transformer, 1998, Eight Pages (total), PX R4–98, USA.

* cited by examiner

*Primary Examiner*—Neil Abrams
(74) *Attorney, Agent, or Firm*—Eleanor M. Musick; Kilpatrick Stockton LLP

(57) ABSTRACT

The transformer box connector comprises a plurality of terminal blocks and a terminal block retainer with a hinged cover mounted on a housing. The terminal block retainer has a plurality of insulating ribs that act as partitions. Terminal blocks for receiving at least one electrical wire are mounted within the spaces between each insulating rib. Each terminal block is mounted to the terminal block retainer by a planar member that extends from its base. A fastening member, which provides an electrical connection from the wire secured in the terminal blocks to the transformer, extends from the planar member and can be configured as a fastening screw or a fastening post. The fastening member provides means for attaching the terminal block to the terminal block retainer and to the transformer housing. The hinged cover may include openings for access to set screws in the terminal blocks.

18 Claims, 5 Drawing Sheets

VOLTAGE TERMINAL CONNECTOR ASSEMBLY

This is a continuation-in-part of application Ser. No. 09/504,698, filed Feb. 16, 2000.

FIELD OF THE INVENTION

The invention relates to a connector assembly for a transformer box for providing power to multiple output devices and more specifically to a transformer box having connection blocks to facilitate connections with improved safety and accessibility.

BACKGROUND OF THE INVENTION

Environmental lighting systems typically operate by providing low voltage to a number of lamps which are positioned to enhance various features in the environment, such as buildings, statues or trees, or to illuminate walkways or open areas for safety. The low voltage, usually 12 volts, is produced by one or more transformers that are connected to a 120 VAC source and positioned within the area covered by the lighting system in a way to ensure a supply of stable voltage levels as well as to operate efficiently. An important consideration when designing a lighting system is light output and lamp life, both of which are optimized when each lamp is operated within a relatively narrow voltage range, e.g., 10.5 to 11.5 volts. Because the light fixtures are usually positioned at varying distances from the transformer box with differing numbers of fixtures on different cables, the voltage requirements for any given cable may differ. Cables to lamps at the greatest distance from the transformer and/or having a greater quantity of lamps will require an initially higher output voltage and/or a heavier gauge of cable to compensate for voltage drop over long stretches of cable and multiple lamps. The physical size of the cable on the 12 volt secondary side can become very large when a cable run requires a high wattage load, such as would be needed for a long path or driveway. Basic electrical theory dictates that the cable conductors on the 12 volt side of the transformer will be much larger than the conductors on the 120 volt primary side. In order to reduce the supply voltage down to a safe 12 volts, the amperage must be increased by a factor of ten. In theory, the cable gauge to carry 300 watts at 12 volts (25 amps) should be 10 times the thickness of the cable from the 120 volt source (2.5 amps.) To correctly account for this relationship, the low voltage connector in a terminal box should be able to accommodate large gauge cables. In conventional outdoor lighting systems, however, this is not the case, and the available connectors do not provide adequate physical openings to securely receive large gauge cables. Another consideration in the lighting system design is centering of the wattage load in order to minimize cable runs, also to avoid excessive voltage drops for efficient use of the supply voltage.

Most existing transformer boxes were designed and built for industrial applications. Although the basic functionality of a transformer box has not changed for many years, there is now a heightened awareness of safety and visual accessibility issues that exist when they are used in a public, commercial, or residential setting, such as in environmental lighting systems. An aspect of environmental lighting systems that creates a particular safety issue is the aforementioned need to center the transformer within a lighting zone for balanced distribution of power. This means that the transformer may be located in a position that is not as easily secured as might be, for example, a service cabinet or closet on the side of a building or garage. Thus, while efforts are usually made to locate the transformer inconspicuously, outside of direct view, they may, nonetheless, be accessible to individuals, including children. Thus, it is important to ensure that wires leading to and from the transformer be firmly secured.

Lighting systems are typically installed by professional installers who will need ready access to the transformer's interior connection points. In existing systems, these connection points are often plastic conduit sleeves into which the bare cable wire is inserted and held in place by a flat-top set screw. Set screws are located within a covering made of plastic or other insulating material to prevent inadvertent contact with metal which may be conducting electricity. In a typical low voltage lighting installation, there are several field cables running into a single terminal connection. It can be difficult for the installer to insert the large gauge, oftentimes stiff wires into the narrow openings. Further, the set screws, which are fairly small, are recessed within the protective material, so the screwdriver must be inserted into an opening in the plastic, making clear visual confirmation of the connection difficult. Most terminal connectors are of a blind type which do no allow the installer to visually confirm the connection by seeing the conductors pass under the set screws. Without a solid connection, arcing and overheating can occur. Although the voltage may be low, the current can be as high as 50 amps. Loose or inadequate metal-to-metal connection with the field wire can be particularly hazardous since the circuit protection in the transformer or main house circuit breaker will not detect an overheated terminal connection because it does not cause a short or an excessive amperage to trip the breaker.

Since the installer is generally well-versed in safe handling of electrical conductors, and since he or she will be doing most of the installation with the system disconnected from a live voltage supply, safety concerns are not as much of an issue as they might be for the uninitiated homeowner or curious child after the lighting system is operational. Thus, the installer may consider the conventional safety features to be obstacles to making secure connections. Regardless of inconvenience to the installer, safety precautions must be taken to avoid accidental electric shock once the 120 VAC is connected.

For the reasons described above, there remains a need for a transformer box construction that allows for easy and secure connection of a lighting system in the smallest-possible physical size enclosure while providing protection against electrical shock for untrained persons who may intentionally or unintentionally gain access to the interior of the transformer box.

SUMMARY OF THE INVENTION

It is an advantage of the present invention to provide a transformer box connector that allows for easy and secure insertion of electrical wires.

It is a further advantage of the present invention to provide a transformer box connector with a hinged cover that protects against direct contact with bare wire or an exposed connector after the system is operational, thereby helping to limit the possibility of severe injury from electrical shock.

Another advantage of the present invention is to provide a transformer box connector that is safe, compact, and simple-to-use.

Yet another advantage of the present invention is to provide a terminal connector that provides means for visual confirmation of a connection.

In an exemplary embodiment, the transformer box connector is encased within a transformer box. The transformer box has a hinged door and an interior volume for retaining a transformer housing. A transformer and other components can be located underneath the housing. The hinged door includes a lip which attaches to the latching mechanism mounted on the side of the transformer box for securing the hinged door. The transformer box will preferably be made of a stainless steal or other similar material so the transformer box will be protected from outside elements. The transformer box is supplied standard household power of 120 VAC via an electrical cable or power cord.

In an exemplary embodiment, the transformer box connector comprises a terminal block retainer mounted on a housing located in the interior of the transformer box. The terminal block retainer has a hinged cover that is pivotally attached at the rear corners of the terminal block retainer. In one embodiment, the hinged cover can be lifted and slide downward from the top of the rear corners so that the hinged cover will be locked into place. In another embodiment, the hinges are configured to provide a catch or lock which allows the cover to be temporarily locked in place in the up position. The hinged cover includes a plurality of openings in its top to allow a screwdriver or fastening device easy access to lower voltage terminals to tighten the setscrew without lifting the hinged cover, thereby eliminating direct contact with an electrically hot wire or connector. The hinged cover will preferably have a plurality of slots or openings in the sides or front corners to allow fastening screws to restrict movement of the hinged cover for additional safety measures.

In one embodiment, the terminal block retainer has a plurality of insulating ribs or partitions. Within each insulating rib of the terminal block retainer, a generally cube-shaped terminal block is mounted to provide for insertion of electrical wires. The insulating ribs separate each terminal block from the other to electrically isolate each connection. The insulating ribs also guard against inadvertent contact with one terminal block when inserting or removing a wire at a neighboring block. The terminal block retainer is a molded plastic or polymer, preferably a material that is tolerant to high temperatures.

Each terminal block is preferably formed from a die cast aluminum or other similar material, but may be machined or molded. Each terminal block has a front face and a top, both having bores formed therethrough which intersect within the block. The front face bore can be formed as a circle, but is preferably off-circular to provide a large diameter opening near the bottom of the block to facilitate insertion of wires. The top bore is internally threaded from the top, preferably all the way to the bottom of the hollow interior of the block. A setscrew is screwed into the top bore for locking wires in place after insertion into the front face bore. In the preferred embodiment, the top to bottom threading of the top bore allows for the setscrew to be adjusted in accommodating from a single thin wire to a bundle of heavy gauge wires.

Each terminal block is mounted to the terminal block retainer by a planar member that is formed at its base and extends horizontally therefrom. A fastening member attaches to the planar member. The fastening member can be configured as a fastening screw or a threaded fastening post, and is formed from a conductive material to provide an electrical conduction path from the terminal block to the transformer taps. The fastening screw or post is inserted through the terminal block retainer and an opening in the housing opening, and is secured at its end by a receiving nut once other connections have been completed.

In an exemplary implementation, an electrical wire from a transformer tap is attached to the fastening member by a round washer crimp or a similar fastening means. The round washer crimp, which attaches to the end of the electrical wire, has a washer portion with a diameter adapted to fit over the fastening member. The washer portion of the round washer crimp is slid onto the end of fastening member and upward until the top portion is butted against the circular shaft of the terminal block retainer. The round washer crimp is secured in place by the receiving nut so that the round washer crimp and the electrical wire is secured between the circular shaft and the receiving nut.

In alternate embodiment, a pair (or more) of retaining sleeves can be used to secure the housing against the terminal block retainer. A retaining sleeve is inserted over the fastening member and the circular shaft of the terminal block retainer on at least one shaft location on either side of a centerline bisecting the terminal block retainer. The retaining sleeves provides upward force against the upper face of the housing to ensure a tight fit between the terminal block retainer and the housing. The receiving nut provides for securing the retaining sleeves in place.

In a second embodiment, the terminal block retainer has partitions extending upward and downward from a plane in which the terminal blocks are positioned. Each cavity or cubicle defined by the partitions has a front wall with an opening formed therein. The terminal blocks have an upper connector portion for retaining wire ends for wires exiting the transformer box. A lower connector portion extending downward from a planar center section is substantially an inverse mirror image of the upper portion and provides connection to wire ends leading from the transformer. In a manner similar to the upper portion of the terminal block, a set screw inserted into a threaded bore perpendicular to the wire ends is used to secure the wire ends inserted into the lower portion of the terminal. A groove extends along the sides of the planar center section to interfit with a corresponding slot in the terminal block retainer. A back plate is attached to the terminal block retainer to enclose the terminal blocks within the cubicles defined by the partitions. Openings in the lower portion of the back plate match up with the wire openings on the lower portion of each terminal block. The wires leading from the transformer are fed through the back plate opening for insertion into the terminal block.

BRIEF DESCRIPTION OF THE DRAWINGS

Understanding of the present invention will be facilitated by consideration of the following detailed description of a preferred embodiment of the present invention taken in conjunction with the accompanying drawings, in which like numerals refer to like parts and in which.

DETAILED DESCRIPTION OF THE INVENTION

Figure 1:
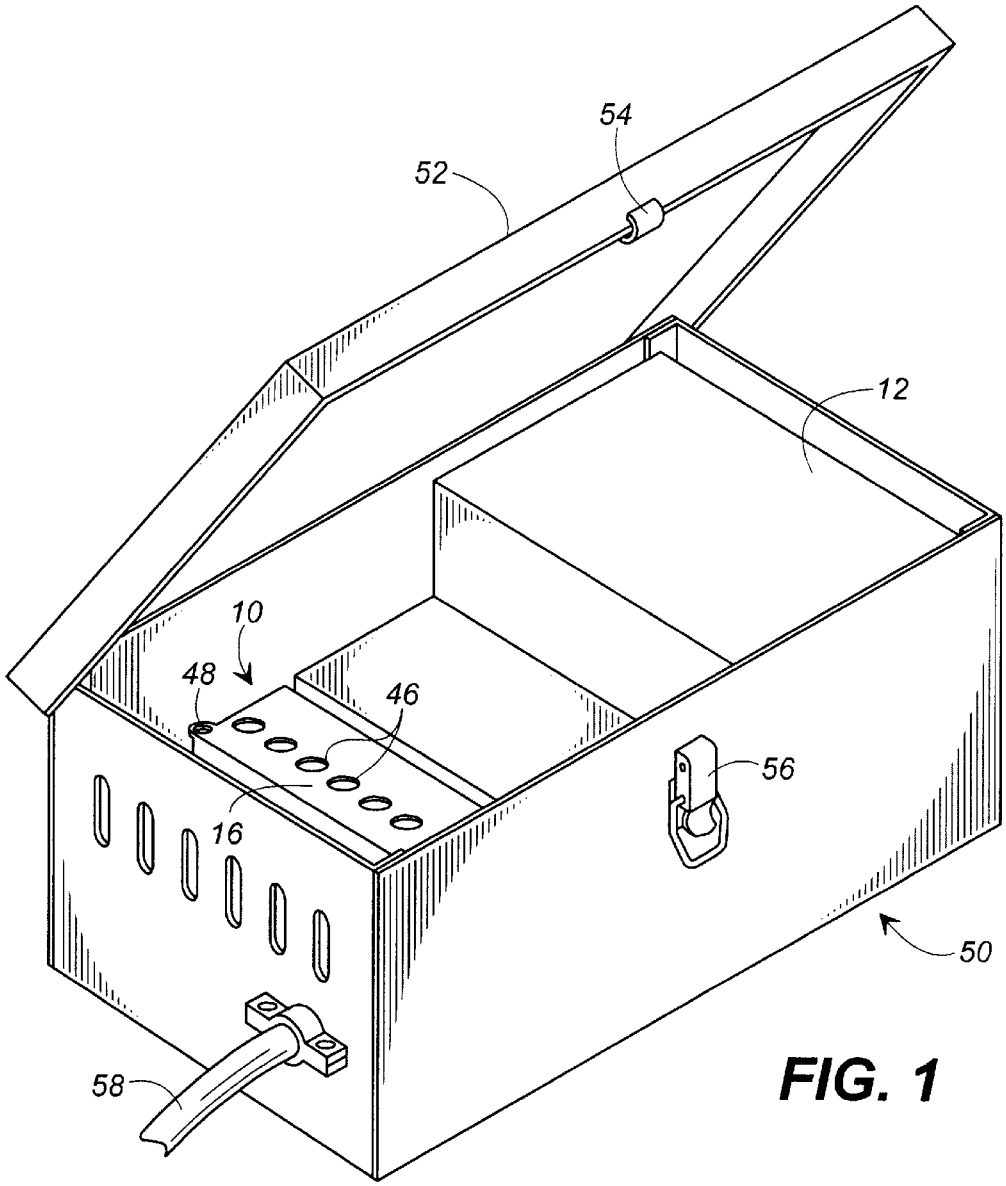
FIG. 1 is a perspective view of a transformer box containing the transformer box connector.

As illustrated in FIG. 1, the transformer box connector 10 is encased within a transformer box 50. The transformer box 50 has a hinged door 52 and an interior recess for a housing 12. A transformer and other components can be located underneath the housing 12. The hinged door 52 includes a lip 54 which attaches to the latching mechanism 56 mounted on the side of the transformer box 50 for securing the hinged door 52. The transformer box 50 will preferably be made of a stainless steel or other similar material so the transformer box 50 will resist corrosion when installed at an outdoor location. The transformer box 50 is connected to a standard household power supply (120 VAC) by the electrical power cord 58 or other appropriate cable connection. Additional components and circuitry for providing stepped-down voltage using the 120 VAC supply are well known to those of skill in the art and, therefore, are not described herein.

Figure 2:
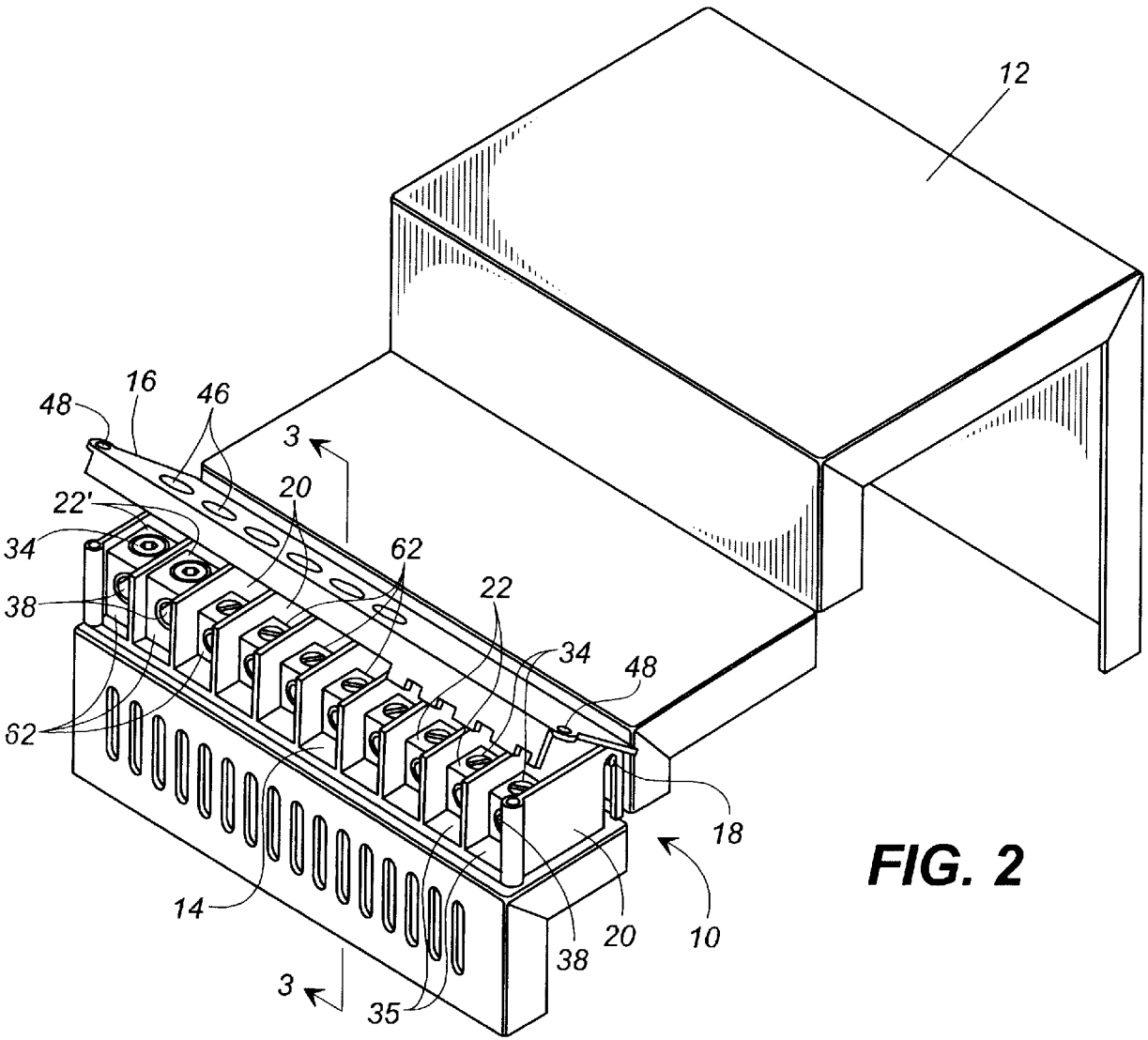
FIG. 2 is a perspective view of the transformer box connector.
Figure 5:
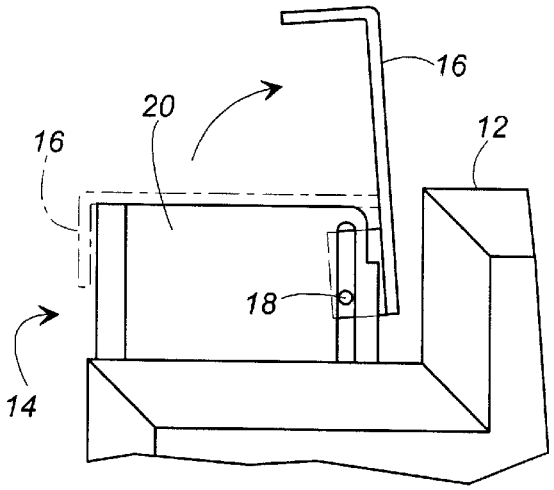
FIG. 5 is a side view of the forward portion of the transformer box of FIG. 2 showing the hinged cover arrangement.

Referring to FIGS. 2 and 5, the transformer box connector comprises a terminal block retainer 14 mounted on a housing 12 located in the interior of the transformer box 50. The terminal block retainer 14 has a hinged cover 16 that is secured by an axial joint 18 located in the rear corners of the terminal block retainer 14. The hinged cover can be lifted and slide downward from the top of the rear corners so that the hinged cover 16 will be locked into place. The hinged cover 16 will preferably have slots or holes 46 in the top, which may be circular or any another shape that provides an opening sufficient to allow a screwdriver or other appropriate tool easy access to tighten the setscrew 34 without lifting the hinged cover 16 , thereby preventing direct contact with the wire or connector. The hinged cover 16 can include a plurality of slots or openings 48 in the front corners or sides to provide for placement of fastening screws to prevent movement of the hinged cover 16 for additional safety measures.

Generally, during installation, hinged cover 16 will be lifted or completely removed, allowing the installer ready access to all terminal blocks 22 to ensure secure connections. After installation, the installer will close and attach the hinged cover 16 to restrict access to the terminal blocks 22 and, thus, live connections. As shown, holes 46 in hinged cover 16 overlie only the stepped-down voltage connections 62, preventing access entirely to the higher input voltage and, thus, eliminating the most significant safety hazard.

The terminal block retainer 14 has a plurality of insulating partitions or ribs 20 which extend upward from a base portion 35, which is generally planar. The ribs 20 are spaced apart so that each space between a pair of ribs, i.e., a cubicle, is adapted to receive a single terminal block 22 so as to permit insertion of electrical wires from a direction 20 that is generally parallel to the direction of the ribs. The ribs 20 are preferably higher than the terminal blocks 22 so that each terminal block is fully recessed within its corresponding space. The ribs 20 provide insulation between adjacent terminal blocks and protect the user from inadvertent contact with one terminal block when working on a neighboring terminal block 22. Terminal block retainer 14 is formed from a molded plastic or polymer, preferably a material that is sturdy and has good high temperature tolerance. Appropriate materials include Ryton® (polyphenylenesulfide) or Ultem® (polyetherimide).

Figure 4:
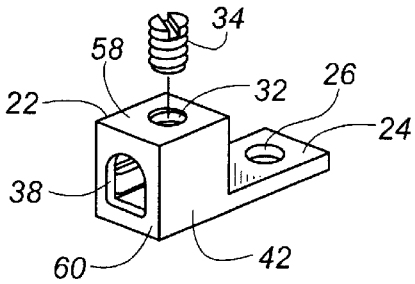
FIG. 4 is a perspective view of a single terminal block.
Figure 3:
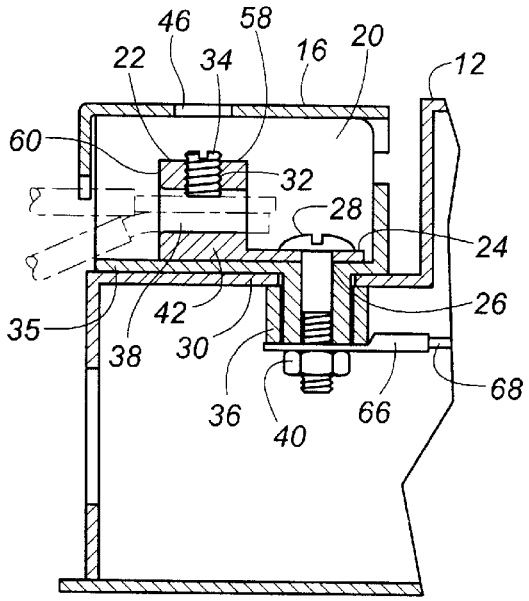
FIG. 3 is an enlarged sectional view taken on line 3—3 of FIG. 2.

Generally, terminal block 22 can be formed of aluminum, by die casting or machining, zinc aluminum alloy, by machining, or other electrically conductive material and appropriate formation method. Alternative methods of manufacturing the terminal block will be readily apparent to those of skill in the art, and may include machining or molding. Referring to FIGS. 3 and 4, in a first embodiment, the body of each terminal block 22 has a front face 60 and a top 58, through which bores 38 and 32, respectively, are formed to intersect within the block. The front face bore 38 can be formed as a circle, but is preferably off-circular, with an inverted U-shape, to provide a larger opening near the bottom of the block to facilitate insertion of larger gauge wires. Bore 38 extends horizontally through the body of the block, exiting from the rear face, allowing the user to readily visually confirm complete insertion and proper contact for all wires to be connected in the terminal block. The large opening, relative to conventional connectors, permits several multi-wire electrical cables to be securely inserted without risk of missing or bending a few wires because the bundle fits so tightly within the connector sleeve. Failure to secure all wires of a cable within a connection 15 can be a significant problem in outdoor lighting systems since it can lead to arcing and overheating at the connection.

Top bore 32 is threaded, preferably from the top to the bottom of the interior of the block, for receiving a setscrew 34 for locking wires in place after insertion into the front face bore 38. The preferred top-to-bottom threading of the top bore 32 provides the widest possible range of travel of setscrew 34 so that a single terminal block can securely attach from one small gauge wire to several larger gauge cables, providing a significant increase in the capacity of the terminal connection as compared to conventional connectors.

Figure 6:
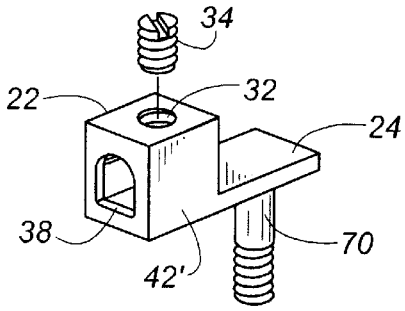
FIG. 6 is a perspective view of an alternative embodiment of the terminal block.

Each terminal block 22 is mounted to the terminal block retainer 14 by way of a planar member 24 that extends horizontally from the base of the generally cube-shaped terminal block body. A fastening member attaches to the planar member 24. The fastening member can be configured as a fastening screw 28 or a fastening post 70 as shown in FIGS. 4 and 6, respectively. In the embodiment of FIG. 4, the planar member 24 has an opening 26 at its center for receiving a fastening screw 28. The fastening screw 28 is inserted at the opening 26 of the planar member 24 passing through the circular shaft 36 of the terminal block retainer, through the housing opening 30, and secured at its end by a receiving nut 40. In the embodiment of FIG. 6, the planar member 24 is solid with an integrally-formed fastening post 70 extending from the underside of the planar member 24. The fastening post 70 is threaded at least at its lower end for attachment of receiving nut 40 once the terminal block is placed on terminal block retainer 14.

The fastening member, i.e., fastening screw 28 or fastening post 70, provides electrical conduction between the terminal block 22 and the transformer. An electrical wire 68 from a transformer tap is attached to the fastening member by a round washer crimp 66 or a similar fastening means. The round washer crimp 66 attaches to the electrical wire 68 allowing for insertion onto the fastening member. The washer portion of the round washer crimp 66 is slid onto the end of fastening member and upward, until the top portion is butted against the circular shaft 36 of the terminal block retainer 14.

Figure 7:
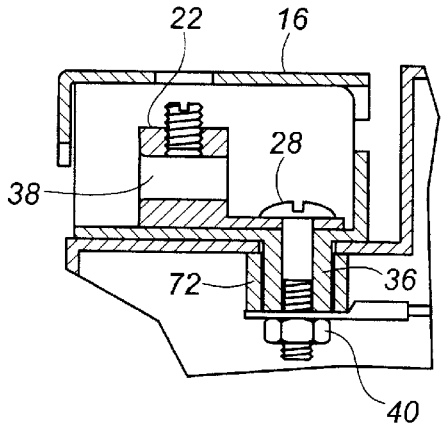
FIG. 7 is an enlarged sectional view taken along line 3—3 of FIG. 2 showing the clamping sleeve.

The round washer crimp 66 is secured in place by the receiving nut 40 so that the round washer crimp 66, and, thus electrical wire 68 is secured between the circular shaft 36 and the receiving nut 40. Referring to FIG. 7 a plurality of retaining sleeves 72 can be used to secure the housing 12 against the terminal block retainer 14 by providing uniform pressure between the upper face of the housing 12 and the terminal block retainer 14. The retaining sleeves 72 are inserted over the fastening member 28 or 70 and mount on the circular shaft 36 of the terminal block retainer 14. The receiving nut 40 provides for securing the retaining sleeves 72 in place. Generally, only two retaining sleeves 72 will be needed, with the sleeves placed on either side of a centerline that bisects the terminal block retainer 14. However, additional retaining sleeves 72 may be used.

Figure 8:
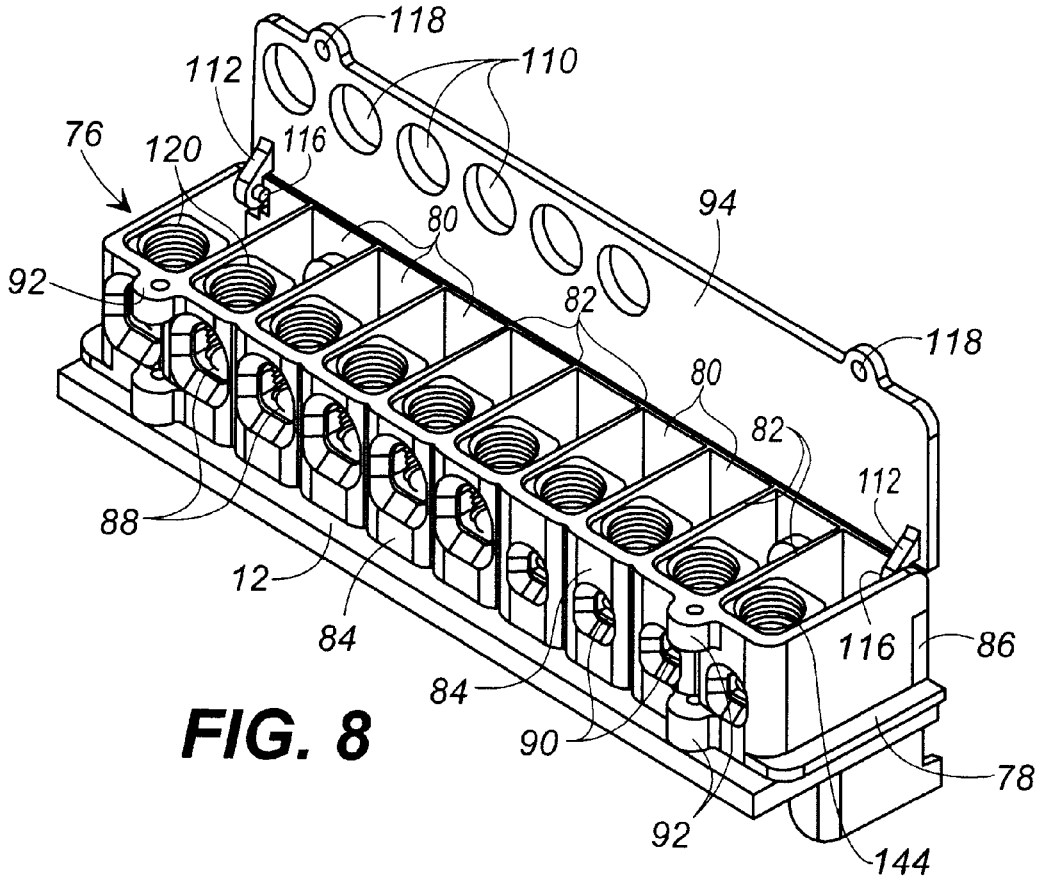
FIG. 8 is a front perspective view of an alternative embodiment of the terminal block retainer.

An alternative embodiment of the terminal block retainer is shown in FIGS. 8–11. Referring first to FIG. 8, terminal block retainer 76 has a plurality of cubicles 80 that are defined by partitions or ribs 82 extending from a planar center portion 78, front wall 84 and rear wall 86. The front wall 84 has a plurality of openings 88 and 90 formed therein through which wire ends (not shown) can be inserted. In order to accommodate the larger gauge wires that are used for connection to the lighting fixtures, openings 88 are preferably made with larger diameters. The outer edges of openings 88 and 90 are chamfered to facilitate insertion of the wire ends. Extending from the front wall 84 are at least two tabs 92 with a bore therethrough for receiving a fastener such as a screw or a cotter pin for locking the hinged cover 94 in a closed position.

Figure 11:
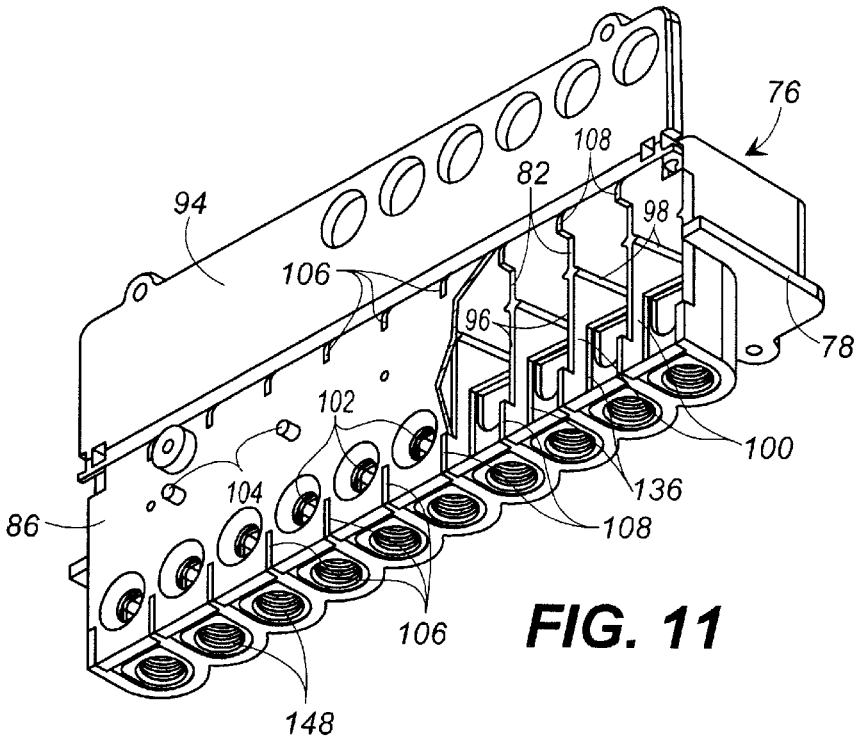
FIG. 11 is a perspective view of the back of the terminal connector block of FIG. 8 with the back plate partially cut away.

FIG. 11 provides a view of the back side of the terminal block retainer 76. Rear wall 86, also referred to as the back plate, is partially cut away, revealing ribs 96, which are effectively continuations of ribs 82. (Note that terminal blocks 120 are not shown in the cut-away portion so that the details of the interiors of the cubicles can be seen.) Where upper cubicles 80 are the spaces within which connection are made to the lighting fixtures, lower cubicles 100, defined by ribs 96 are the spaces within which connection is made to the transformer. At the dividing line between each upper rib 82 and lower rib 96, ridge 98 is formed. Ridge 98 provides means for fixing the terminal blocks 120 in place within the terminal block retainer 76, as described below.

For ease of manufacture, in the preferred embodiment, planar center portion 78, ribs 82 and 96, front wall 84 with openings 88 and 90, and tabs 92 are molded as a unit to form the main section of the terminal block retainer 76. As with the previously described embodiment, the material of which the terminal block retainer is made is a temperature tolerant plastic or polymer such as Ryton® or Ultem®. Back plate 86 is formed as a separate piece and attached after the terminal blocks 120 are in place. Openings 102 are formed through back plate 86, with one opening corresponding to each lower cubicle 100, providing access to each cubicle 100 and allowing wires to be fed to and from the transformer. Openings 102 are chamfered on their outer edges to facilitate feeding wire into cubicle 100. A plurality of pegs or pins 104 extend a short distance from the outer surface of back plate 86 to maintain the terminal block retainer 76 a fixed spacing from the adjacent section of the transformer housing 12 (shown in FIG. 1). A plurality of slots 106 formed in the upper and lower edges of back plate 86 provide means for attaching back plate 86 to the main portion of the terminal block retainer 76. When properly aligned, slots 106 mate with tabs 108 extending from the ribs 82 and 96, snapping into place to create an interference fit when the two pieces are pressed together. Alternatively, openings can be formed in back plate 86 to correspond to bores in the main portion of the terminal block retainer 76 to permit appropriate fasteners to be inserted. Back plate 86 is formed via molding from the same materials as the main portion of the terminal block retainer 76.

Cover 94 is formed in a manner similar to that described for the embodiment shown in FIGS. 2 and 3 except that no overhanging lip is included because of the inclusion of front wall 84 in the present embodiment. Openings 110 are provided for access to set screws for the low voltage connections without requiring the cover 94 to be opened. Tabs 112 extend downward from each end of the inside surface of cover 94. Pins 114 extending perpendicular to tabs 112 act as pivot points. Pins 114 sit within a hinge recess 116 formed by the combination of recesses in each of back plate 86 and the ribs 82 at each end of the main portion of the terminal block retainer 76. The shape of recess 116 is such that when cover 94 is lifted to vertically align cover 94 with back plate 86, cover 94 will stay in the upright position until it is intentionally lowered by the installer. When closed, openings 118 in cover 94 are aligned with the bores in tabs 92 provide means for fastening the cover in a closed position. Screws or other appropriate fasteners are then used to fasten the cover, fully enclosing the terminal blocks 120.

Figure 9:
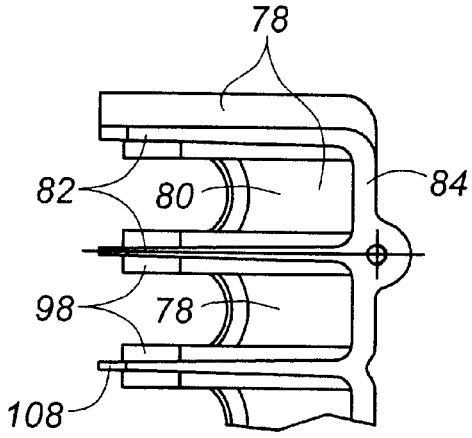
FIG. 9 is a top detail view of a portion of the terminal block retainer of FIG. 8.
Figure 10:
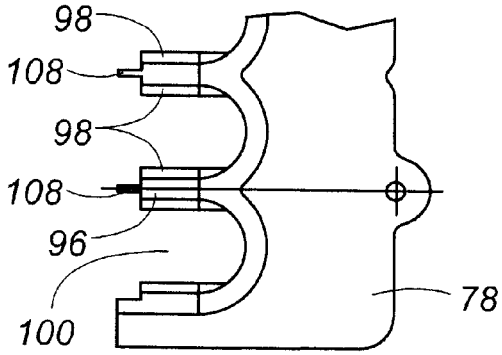
FIG. 10 is a bottom detail view of a portion of the terminal block retainer of FIG. 8.

FIGS. 9 and 10 show the top and bottom views, respectively of cubicles 80 and 100. Looking at FIG. 9, ribs 82 separate the two cubicles 80 that are shown in the figure. Extending perpendicular to ribs 82 are ridges 98 and center planar portion 122. Center planar portion 122 spans the space between ribs 82 at the forward part of cubicle 80 providing a stage upon which a terminal block 120 is supported. The U-shaped cut-out at the rearward part of cubicle 80 corresponds to lower cubicle 100. When viewed from the bottom, as shown in FIG. 10, the bottom surface of center planar portion 122 is visible as is the U-shaped cut-out which corresponds to cubicle 100.

Figure 12:
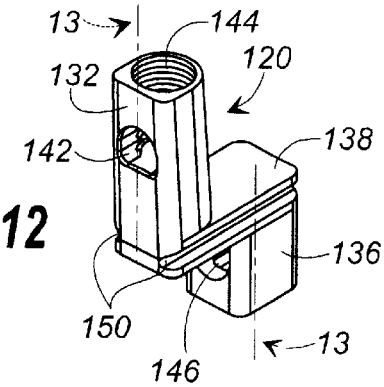
FIG. 12 is a perspective view of an alternate embodiment of the terminal block.
Figure 13:
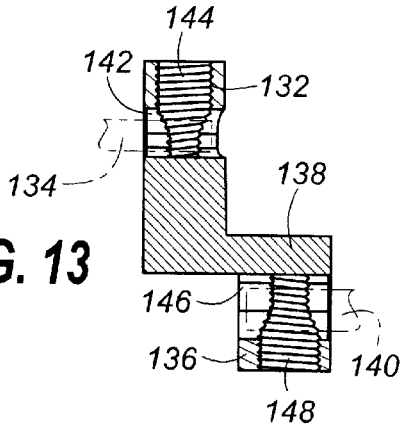
FIG. 13 is a cross-sectional view taken along line 13—13 of FIG. 12.

An alternative embodiment of the terminal block for use in combination with the terminal block retainer 76 is illustrated in FIGS. 12 and 13. Each terminal block 120 has an upper connector portion 132 for retaining wire ends 134 for wires exiting the transformer box. A lower connector portion 136 extends downward from planar center section 138 to form a substantially inverse mirror image of upper portion 132. Lower connector portion 136 provides connection to wire ends 140 for wires which connect to the transformer. As in the embodiment of FIGS. 4 and 6, the upper connector portion 132 has two intersecting bores. Horizontal bore 142 acts as a port for insertion of wire end 134 into the connector. In the preferred embodiment, the shape of bore 142 is adapted to facilitate insertion of wire end 134, including chamfering at its outer edge and an inverted U-shape, however, any shape that provides for ease of insertion of the wire may be used. Vertical bore 144 is threaded to receive a set screw (not shown) in a direction perpendicular to wire end 134 to lock the wire end in position by forcing it against the bottom of bore 142.

Lower connector portion 136 extends downward from the planar center section 138 at a dog-leg relative to upper connection portion 132. In a manner similar to the upper portion 132 of the terminal block, lower connector portion 136 has bores 146 and 148 formed therein. Bore 146 extends horizontally, acting as a port to receive wire end 140 and is shaped to facilitate insertion of the wire end. Bore 148, which is perpendicular to bore 146, is threaded for inserted of a set screw (not shown) to secure wire end 140 to provide a secure connection.

Planar center section 138 has a groove 150 extending along each of its sides to interfit with a corresponding set of ridges 98 in the terminal block retainer. A terminal block 120 is placed at the back of the main section of the terminal block retainer between ribs 82 so that the grooves 150 are aligned with ridges 98. By sliding terminal block 120 along ridges 98 forward toward the front wall 84, terminal block 120 is securely held in place. The U-shaped cut-outs closely fit with the edges of the terminal block, allowing terminal block 120 to be slid adjacent to front wall 84 so that openings 88 and 90 in front wall 84 are aligned with bore 142 of each terminal block 120. After a terminal block 120 is placed within each cubicle 80/100, Back plate 86 is attached to the main section of terminal block retainer 120 to enclose the terminal blocks within the cubicles defined by the partitions. Back plate openings 102 match up with bores 146 in the lower portion 136 of each terminal block. The wires ends leading from the transformer can then fed be through the back plate openings 102 for insertion into the corresponding bores 146 in terminal block 120. Terminal block retainer is attached to the housing 12 (shown in FIG. 2) by fasteners which can be passed through planar center portion 78 and through housing 12. For example, screws or bolts can be inserted through tabs 92 and into corresponding holes in housing 12.

Figure 14:
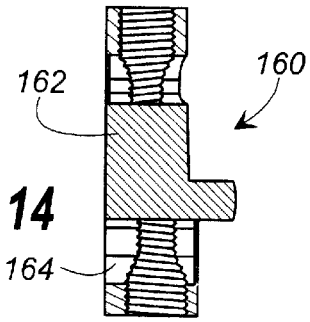
FIG. 14 is a cross-sectional view of another alternative embodiment of the terminal block.

In an alternate embodiment of the terminal block shown in FIG. 14, the dog-leg configuration of terminal block 130 is eliminated, and the body is formed with the upper and lower connection portions 162 and 164 substantially vertically aligned. The bores for insertion of wire ends and set screws are formed in a manner similar to the previously-described embodiments. Attachment of the terminal block 160 is achieved in a manner similar to that for the embodiment of FIG. 12, although selection of alternate fastening methods and devices will be readily apparent to those of skill in the art.

The transformer box connector of the present invention provides many advantages over devices currently available for use in lighting systems. Among these advantages, it allows for secure and protected insertion of electrical wires having a wide range of thickness, while still being compact and simple-to-use. The open construction of the terminal block allows the user to visually confirm secure connection. The hinged cover provides ready access during installation, but thereafter protects against accidental contact with a bare wire or an exposed connector, thereby reducing the risk of injury from electrical shock.

It will be apparent to those skilled in the art that various modifications and variations may be made in the apparatus and process of the present invention without departing from the spirit or scope of the invention. Thus, it is intended that the present invention cover the modification and variations of this invention provided they come within the scope of the appended claims and their equivalents.

I claim:

1. A transformer box connector comprising:

a housing;

a terminal block retainer disposed on the housing, the terminal block retainer comprising a plurality of cubicles, wherein each cubicle is electrically insulated from other cubicles;

a plurality of electrically-conductive terminal blocks disposed within the plurality of cubicles, with one terminal block mounted within each cubicle, each terminal block comprising a planar center section having an upper surface and a lower surface, an upper portion extending from the upper surface and a lower portion extending from the lower surface, each of the upper portion and the lower portion having a first bore formed therein for receiving a wire end and a second bore intersecting the first bore for inserting a locking fastener for securing the wire end within the first bore.

2. A transformer box connector as in claim 1, wherein each cubicle comprises a front wall, a back wall and sides comprising two ribs, and wherein each of the front wall and the back wall has a plurality of openings formed therein for access to the first bore in each of the upper and lower portion of the terminal block.

3. A transformer box connector as in claim 1, wherein each of the two ribs has a ridge formed thereon for mating with a groove formed in each of the two sides of the planar center section of the terminal block for securing the terminal block within the cubicle.

4. A transformer box connector as in claim 1, further comprising a hinged cover attached to the terminal block retainer for enclosing the plurality of terminal blocks within the plurality of cubicles.

5. A transformer box connector as in claim 4, wherein the hinged cover is releasably fastenable to the terminal block retainer.

6. A transformer box connector as in claim 4, wherein a first portion of the hinged cover has a plurality of openings formed therein for providing access to terminal blocks connected to a stepped-down voltage and a second portion of the hinged cover prevents access to terminal blocks connected to a source voltage.

7. A transformer box connector as in claim 1, wherein the second bore in each of the upper and lower portions of the terminal block is threaded and the locking fastener is a set screw.

8. A transformer box connector as in claim 1, wherein the first bore in each of the upper and lower portions of the terminal block has a cross-sectional shape of an inverted U.

9. A transformer box connector as in claim 8, wherein the high temperature plastic or polymer is Ultem® or Ryton®.

10. A transformer box connector as in claim 1, wherein the terminal block is formed from aluminum or an aluminum alloy.

11. A transformer assembly comprising:

a housing;

a transformer;

a plurality of conductive connectors, each connector comprising a planar center section having an upper surface and a lower surface, an upper portion extending from the upper surface and a lower portion extending from the lower surface, each of the upper portion and the lower portion having at least one port for receiving at least one wire, a first group of the connectors being adapted for providing connection between a high voltage source and the transformer and a second group of the connectors being adapted for receiving a stepped-down voltage from the transformer, wherein each connector is electrically connected to the transformer;

a plurality of insulating ribs adapted to enclose each of the conductive connectors on at least two sides, wherein each connector is separated from an adjacent connector by an insulating rib; and a cover disposed within the housing and adapted to cover the plurality of conductive connectors and the plurality of insulating ribs, the cover having a first portion with a plurality of openings formed therein for providing access to the second group of conductive connectors and a second portion adapted to prevent access to the first group of conductive connectors.

12. A transformer assembly as in claim 11, wherein the cover is pivotably attached to at least two of the plurality of insulating ribs at a hinge.

13. A transformer assembly as in claim 11, further comprising a front wall and a back wall disposed adjacent the plurality of insulating ribs to form a cubicle enclosing each conductive connector, wherein each of the front wall and back wall have openings therethrough for feeding the at least one wire into the conductive connector.

14. A transformer assembly as in claim 11, further comprising a front wall and a back wall disposed adjacent the plurality of insulating ribs to form a cubicle enclosing each conductive connector.

15. A connector for a transformer box having a transformer disposed therein, comprising:

a body comprising a conductive material having a planar center section, an upper portion extending upward from the planar center section and a lower portion extending downward from the planar center section, the upper portion having a first upper bore formed within an outward-facing face for receiving at least one first wire end from an external wire running outside of the transformer box and a second upper bore intersecting the first upper bore, and the lower portion having a first lower bore formed within an inward-facing face for receiving a second wire end from an internal wire connected to the transformer and a second lower bore intersecting the first lower bore; and a fastener inserted into each of the second upper bore and the second lower bore for securing the at least one first wire end within the first upper bore and the second wire end within the first lower bore.

16. A connector as in claim 15, wherein the first lower bore has an inverted U-shape.

17. A connector as in claim 15, wherein the first upper bore has an inverted U-shape.

18. A connector as in claim 15, wherein the body is formed from aluminum or aluminum alloy.

* * * * *